United States Patent [19]

Funaki

[11] Patent Number: 4,715,157

[45] Date of Patent: Dec. 29, 1987

[54] ROOF STRUCTURE AND ROOF BOARD THEREFOR

[76] Inventor: Motokatsu Funaki, 430 Shimotsuchidana, Fujisawa-shi, Kanagawa-ken, Japan

[21] Appl. No.: 888,603

[22] Filed: Jul. 23, 1986

[30] Foreign Application Priority Data

Jul. 24, 1985 [JP] Japan ..... 60-162133
Apr. 10, 1986 [JP] Japan ..... 61-81086

[51] Int. Cl.[4] ..... E04D 1/00
[52] U.S. Cl. ..... 52/529; 52/522
[58] Field of Search ..... 52/529, 518, 519, 522, 52/527, 530, 531, 536

[56] References Cited

U.S. PATENT DOCUMENTS 2,642,968 6/1953 Roush et al. ..... 52/522 X
4,122,643 10/1978 Hafner ..... 52/529 X
4,231,206 11/1980 Hafner ..... 52/529
4,593,512 6/1986 Funaki ..... 52/519

FOREIGN PATENT DOCUMENTS 3416791 3/1985 Fed. Rep. of Germany ..... 52/519

*Primary Examiner*—William F. Pate, III
*Assistant Examiner*—Creighton Smith
*Attorney, Agent, or Firm*—Blum Kaplan

[57] ABSTRACT

A roof structure and a roof board therefor are disclosed which are capable of effectively preventing rainwater, sand, dust and the like from entering into the roof structure and exhibiting satisfied snow break. The roof structure is constructed to have a butt region between an eaves side connection of a ridge side roof board and a ridge side connection of an eaves side roof board formed at a position upwardly apart from a flat surface section of the eaves side roof board. The roof structure is constructed by connecting a plurality of the roof boards to one another through the eaves side and ridge side connections in turn with an upward incline from an eaves side to a ridge side. The eaves side connection has an upper front face section downwardly extending from one end of the flat surface section of the roof board and the ridge side connection has a lower front face section upwardly extending from the other end of the flat surface section, so that the connection between each adjacent two roof boards may be carried out by engaging the eaves side connection of the ridge side roof board with the ridge side connection of the eaves side roof board in a manner to abut a lower end of the upper front face section of the ridge side roof board against an upper end of the lower front face section of the eaves side roof board.

12 Claims, 28 Drawing Figures

ROOF STRUCTURE AND ROOF BOARD THEREFOR

BACKGROUND OF THE INVENTION

1. Field of the Invention

This invention relates to a roof construction and a roof board therefor, and more particularly to a roof board adapted to be roofed in the direction of from an eaves side to a ridge side and a roof structure constructed by such roof boards.

2. Description of the Prior Art

Conventionally, various kinds of roof boards each formed at both ends thereof with an eaves side connection and a ridge side connection through which a plurality of the roof boards are connected to one another in order from an eaves side to a ridge side to construct a roof structure have been proposed. The eaves side and ridge side connections are also intended to prevent rainwater from entering therethrough into a roof structure.

Now, the conventional roof board will be described hereinafter with reference to FIGS. 1 to 6.

FIG. 1 illustrates one example of the conventional roof board and FIG. 2 shows an engagement between adjacent two roof boards in a conventional roof structure constructed by the roof boards. A roof board generally designated by reference numeral 30 in FIG. 1 may be formed of a lengthwise steel sheet of a fixed width to which baking finish for rust prevention was applied. More particularly, the steel sheet is first subjected to a shaping process using a suitable forming machine to form the roof board 30 which has a flat surface section 32, an eaves side or lower side connection 34 contiguous to one end of the flat surface section 32 and a ridge side or upper side connection 36 contiguous to the other end of the flat surface section 32. The so-formed roof board 30 is then cut at both sides thereof to have a predetermined width. Thereafter, the roof board 30 may be formed at both sides thereof with side connections (not shown) which serve to laterally connect a plurality of such roof boards to each other in order. The side connections may be formed in a manner such that one is turned up and the other is turned down so as to be engaged with a turned-up one end of a laterally adjacent roof board.

The eaves side connection 34 of the roof board 30 is formed into a substantially C shape so as to have a top section 38 obliquely downwardly extending from the one end of the flat surface section 32, a front face section 40 downwardly extending from the obliquely downwardly extending portion 38, an inwardly extending section 42 inwardly connected to a lower end of the front face section 40 and upwardly curved at a middle portion 44 thereof, and a turned-up end section 46 formed at a distal end of the inwardly extending portion 42.

The ridge side connection 36 is formed to have a a mount-shaped section 50 formed at the other end of the flat surface section 32 so as to obliquely upwardly and inwardly extend therefrom. The mount-shaped section 50, as shown in FIG. 1, is often connected to the flat surface section 32 through a section 48 slightly obliquely upwardly and outwardly extending from the other end of the section 32. The mount-shaped section 50 is provided with a first crest 52 and a second crest 54 in turn to define a trough 56 therebetween and an obliquely downwardly directed end 58.

A plurality of the roof boards 30 constructed as described above are upwardly arranged in turn. More particularly, the eaves side or lower side roof board of each adjacent two of the roof boards 30 is first mounted on common rafters 60 through an excelsior board 62 arranged therein so as to act as a backing material using a suitable means such as fixtures, and then the ridge side or upper side one of the adjacent two roof boards 30 is mounted on the common rafters in substantially the same manner and connected to the eaves side roof board 30 by engaging the ridge side connection 36 of the eaves side roof board 30 with the eaves side connection 34 of the ridge side roof board 30 in a manner to receive the inwardly extending section 42 of the ridge side roof board in the ridge side connection 36 of the eaves side roof board and abut the obliquely downwardly directed end 58 of the eaves side roof board against an inner surface of the front face section 40 of the ridge side roof board, as shown in FIG. 2. Such mounting and connection of the roof boards are repeated, so that a roof structure may be completed.

The connection of the roof boards 30 as described above causes a first evacuated space 64 to be formed between an upwardly curved middle portion 44 of the inwardly extending section 42 and the slightly obliquely upwardly extending section 48, a second evacuated space 66 to be formed in the ridge side connection 36 adjacent to a connection between the mount-shaped section 50 and the slightly obliquely upwardly extending section 48 and a third evacuated space 68 to be defined due to cooperation among a second crest 54, the front face section 40 and the inwardly extending section 42.

Another example of the conventional roof board is shown in FIG. 3. Each of eaves side and ridge side roof boards 30 shown in FIG. 3 likewise is formed to have a flat surface section 32, an eaves side connection 34 contiguous to one end of the flat surface section 32 and a ridge side connection 36 contiguous to the other end of the section 34. The eaves side connection 34 is formed in substantially the same manner as that shown in FIG. 1. However, the ridge side connection 36 is formed in a different manner. The ridge side connection 36 is formed to have a section 48 slightly obliquely upwardly extending from the flat surface section 32, a first turned-up 50' formed at a distal end of the section 48 and adapted to receive an inwardly extending section 42 of the ridge side roof board 30 in cooperation with the section 48, a second turned-up section 70 connected to the first turned-up section 50', an upwardly projected section 72 connected to the second turned-up section 70, and a flat section connected to the projected section 72 and substantially flash with the slightly obliquely upwardly extending section 48. In the roof board 30 of FIG. 3 constructed as described above, the inwardly extending section 42 of the ridge side roof board is received in a gap defined between the slightly obliquely upwardly extending section 48 and first turned-up section 50' of the eaves side roof board, and a connection between the first and second turned-up sections 50' and 70 is abutted against an inner surface of the front face section 40, so that a first evacuated space 64' and a second evacuated space 66' may be formed between the first turned-up section 50' and the inwardly extending section 42 and in a region within the eaves side connection 34 above the second turned-up section 70, respectively.

A further example of the conventional roof board is shown in FIG. 4. A roof board 30 shown in FIG. 4 is formed to have a flat surface section 32, an eaves side connection 34 and a ridge side connection 36 like those shown in FIGS. 1 and 3. The eaves side connection 32 includes an obliquely downwardly extending section 38 connected to one end of the flat surface section 32, a front face section section 40 connected to the section 38, an inwardly extending section 42 connected to the section 39 and curved up at a middle portion thereof, and a turned-up section 46 connected to the section 42 which are formed in order. The ridge side connection 36 includes a slightly obliquely upwardly extending section 48 connected to the other end of the flat surface section 32 and a turned-up section 50 connected to the section 48 and having a distal end 58 directed obliquely downwardly.

A plurality of the roof boards 30 of FIG. 4 constructed as described above are upwardly connected in turn, as shown in FIGS. 5 and 6. More particularly, the eaves side roof board of each adjacent two of the roof boards 30 is mounted through an excelsior board (not shown) on common rafters 60 arranged to obliquely upwardly extend from an eaves side to a ridge side using a suitable means such as fixtures, and then the ridge side one of the adjacent two roof boards 30 is mounted on the common rafters in substantially the same manner and connected to the eaves side roof board 30 by engaging the ridge side connection 36 of the eaves side roof board 30 with the eaves side connection 34 of the ridge side roof board 30 in a manner to receive the turned-up section 50 of the eaves side roof board 30 in the eaves side connection 34 of the ridge side roof board 30 and fit an overall outer surface of the turned-up end section 46 of the ridge side roof board 30 in a base portion of the turned-up end section 50 of the eaves side roof board 30. Such mounting and connection of roof boards is repeated, so that a roof construction may be completed.

As can be seen from the foregoing, the engagement between the eaves side connection and the ridge side connection in the conventional roof structure is basically carried out in such a manner that a butt region between the ridge side connection of the eaves side roof board and the eaves side connection of the ridge side roof board is formed on a plane of substantially the same level as or slightly above the flat surface section of the eaves side roof board, as indicated at reference numeral 74 in each of FIGS. 2, 3 and 6. Unfortunately, this causes wind and rain blown up along a gradient of the flat surface section 32 of the roof board to concentratedly strike the butt region 74, resulting in a large pressure being applied to the region 74. This results in the butt region 74 providing a drift of dust, snow and the like and causes wind and rain blown against the region 74 to be laterally guided along the region 74 and jump up along the front face section 40.

Accordingly, as shown in FIG. 6, a pressure A of wind and rain directly blown against the butt region, a pressure B of jumping-up wind and rain and a pressure C due to the synthesis between the pressures A and B are applied to the butt region 74. It was found that the pressure A is apt to cause rainwater to enter through the butt region 74 into an interior of the roof structure due to a capillary action. The pressure B and C cause a gap to be formed at the butt region 74 which is sufficient to substantially increase the penetration of rainwater into the roof structure. In particular, it is often observed that foreign matters such as sand, mud, dust and the like accompanied by strong wind and rain enter into the roof structure and are collected therein to cause the rust and corrosion of the structure to occur due to a galvanic action and the like. Also, rainwater which once entered into the roof structure is highly hard to be discharged therefrom, resulting in the corrosion being further promoted. This also causes the rainwater to be frozen in the roof structure in winter at a cold district to further damage it due to freeze expansion.

Further, a height of the engagement between the eaves side connection and the ridge side connection is not sufficient to permit the roof structure to exhibit satisfied snow break. Accordingly, when much snow lies on the roof structure, reaction force E of snow load D is generated in the direction of further opening the butt region 74 to cause snow water to flow through the opened butt region 74 into the structure.

Moreover, in the conventional roof structure constructed as described above, a space 75 is often formed between the flat surface section 32 and the common rafters 60, as shown in FIGS. 5 and 6, so that sudden or strong wind causes the roof structure to be loosened. This leads to the generation of noise due to the beating of rain drops against the roof boards. Such noise is amplified in the space 75.

Accordingly, it would be highly desirable to develop a roof structure which is capable of forming a butt region between an eaves side connection and a ridge side connection which effectively prevents the penetration of wind and rainwater through the butt region into an interior of the roof structure and a roof board therefor.

SUMMARY OF THE INVENTION

Generally speaking, in accordance with one aspect of the present invention there is provided a roof board. The roof board includes a flat surface section, an eaves side connection formed at one end or an eaves side end of the flat surface section and a ridge side connection formed at the other end or a ridge side end of the flat surface section, so that a plurality of the roof boards may be connected to one another in order through the eaves side and ridge side connections with an upward incline in the direction from an eaves side to a ridge side to construct a roof structure.

The eaves side connection is formed to have an upper front face section downwardly extending from the one end of the flat surface section, an inwardly extending section inwardly extending from a lower end of the upper front face section and an engagement section formed at a distal end of the inwardly extending section. The ridge side connection is formed to have a lower front face section upwardly extending from the other end of the flat surface section, an outwardly extending section outwardly extending from an upper end of the lower front face section and an envelope section formed at a distal end of the outwardly extending section.

The connection between each adjacent two of the roof boards constructed as described above is carried out by holding the engagement section of the ridge side one of the adjacent two roof boards in the envelope section of the eaves side one of the two roof boards and abutting the upper end of the lower front face section of the eaves side roof board against the eaves side connection of the ridge side roof board to form a butt region therebetween which is positioned upwardly apart from the flat surface section of the eaves side roof board and exposed to an interior of the roof structure.

In accordance with another aspect of the present invention, a roof structure is provided. The roof structure includes a plurality of roof boards connected to one another in order with an upward incline in the direction form an eaves side to a ridge side. The roof boards each are formed to have a flat surface section, an eaves side connection formed at one end of the flat surface section so as to be positioned below the flat surface section and a ridge side connection formed at the other end of the flat surface section so as to be positioned above the flat surface section.

The eaves side connection is formed to have an upper front surface section downwardly extending from the flat surface section, an inwardly extending section inwardly extending from a lower end of the upper front face section and an engagement section formed at a distal end of the inwardly extending section. The ridge side connection is formed to have a lower front face section upwardly extending from the other end of the flat surface section, an outwardly extending section outwardly extending from an upper end of the lower front face section, an envelope section formed by turning up a distal end of the outwardly extending section and a mounted section upwardly extending from the envelope section.

Accordingly, it is an object of the present invention to provide a roof board which is capable of constructing a roof structure having a butt region formed between an eaves side connection and a ridge side connection which is sufficient to effectively prevent the penetration of wind and rain water through the butt region into an interior of a roof structure.

It is another object of the present invention to provide a roof board which is capable of constructing a roof structure which has a butt region between an eaves side connection and a ridge side connection formed at a position upwardly apart from a flat surface section of an eaves side roof board.

It is another object of the present invention to provide a roof board which is capable of constructing a roof structure which effectively prevents foreign matters such as rainwater, sand and the like from entering thereinto.

It is another object of the present invention to provide a roof board which is capable of constructing a roof structure which exhibits satisfied snow break.

It is a further object of the present invention to provide a roof structure which has a butt region formed between an eaves side connection and a ridge side connection which is sufficient to effectively prevent the penetration of wind and rain water through the butt region into an interior of a roof structure.

It is still another object of the present invention to provide a roof structure which has a butt region between an eaves side connection and a ridge side connection formed at a position upwardly apart from a flat surface section of an eaves side roof board.

It is yet another object of the present invention to provide a roof structure which effectively prevents foreign matters such as rainwater, sand and the like from entering thereinto.

It is a further object of the present invention to provide a roof structure which is capable of exhibiting satisfied snow break.

It is still a further object of the present invention to provide a roof structure which is capable of substantially preventing generation of noise due to the beating of rain drops against the structure.

It is yet a further object of the present invention to provide a roof structure which is capable of exhibiting a good appearance.

Still other objects and advantages of the invention will in part be obvious and will in part apparent from the specification.

The invention accordingly comprises the features of construction, combination of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Now, a roof structure and a roof board therefor according to the present invention will be described hereinafter with reference to FIGS. 7 to 21 of the accompanying drawings.

Figure 1:
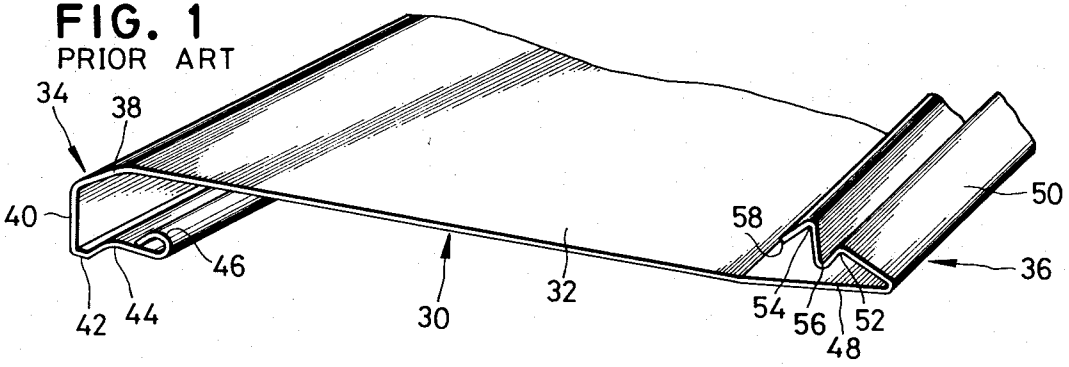
FIG. 1 PRIOR ART
FIG. 1 is a fragmentary perspective view showing an example of a conventional roof board.
Figure 2:
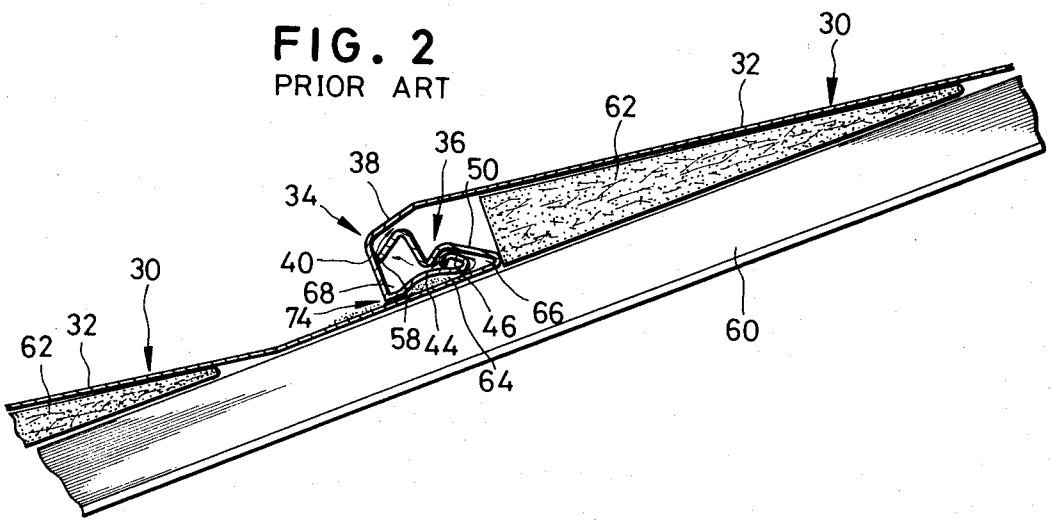
FIG. 2 PRIOR ART
FIG. 2 is a side elevation view in section showing a connection between an eaves side connection and a ridge side connection in a conventional roof structure constructed by the roof boards shown in FIG. 1.
Figure 3:
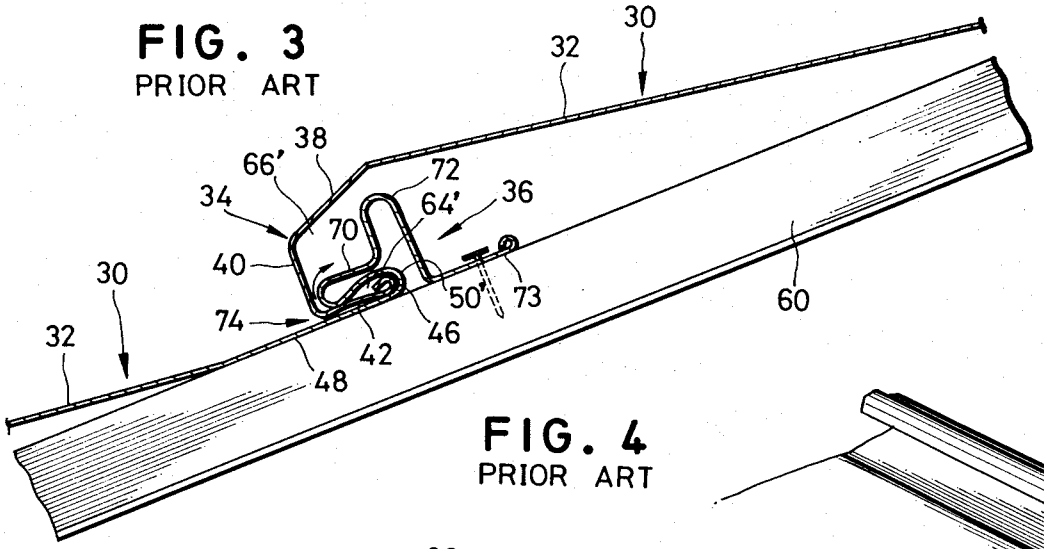
FIG. 3 PRIOR ART
FIG. 3 is a side elevation view in section showing a connection between an eaves side connection and a ridge side connection in a conventional roof structure constructed by another type of conventional roof boards.
Figure 4:
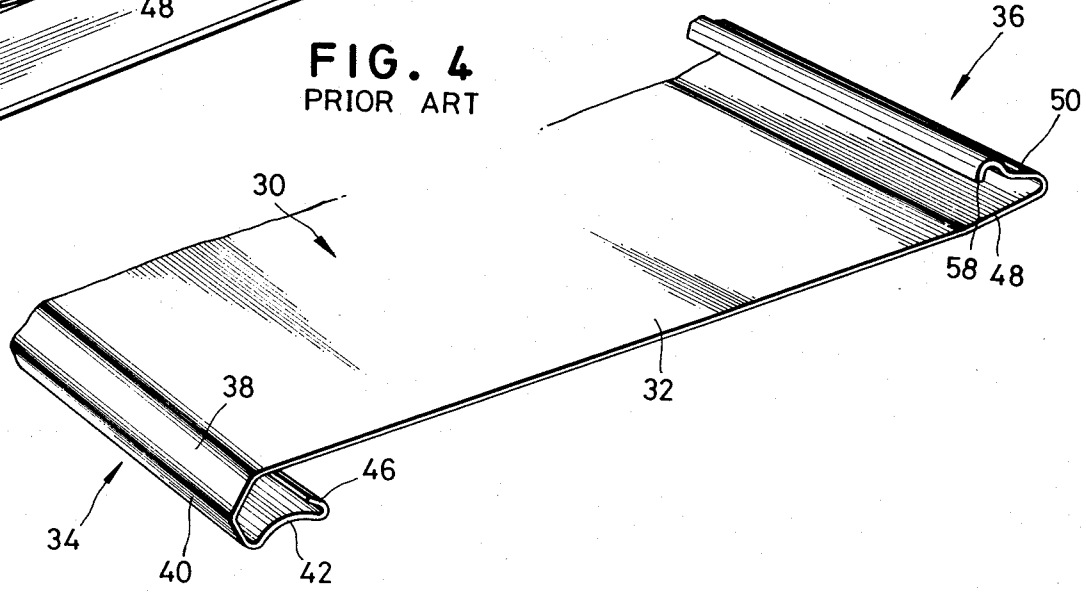
FIG. 4 PRIOR ART
FIG. 4 is a fragmentary perspective view showing a further example of a conventional roof board.
Figure 5:
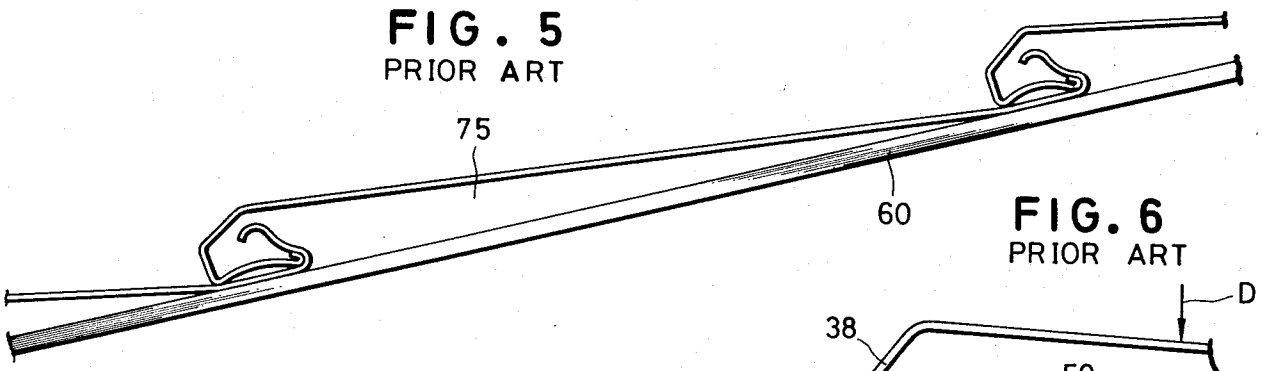
FIG. 5 PRIOR ART
FIG. 5 is a fragmentary side elevation view showing a conventional roof structure constructed by the roof boards of FIG. 4.
Figure 6:
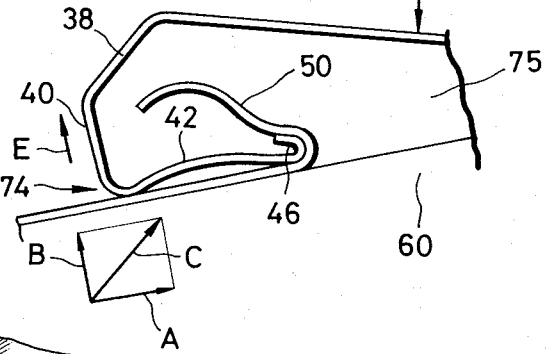
FIG. 6 PRIOR ART
FIG. 6 is an fragmentary enlarged view showing the engagement between an eaves side connection and a ridge side connection in the roof structure of FIG. 5.
Figure 7:
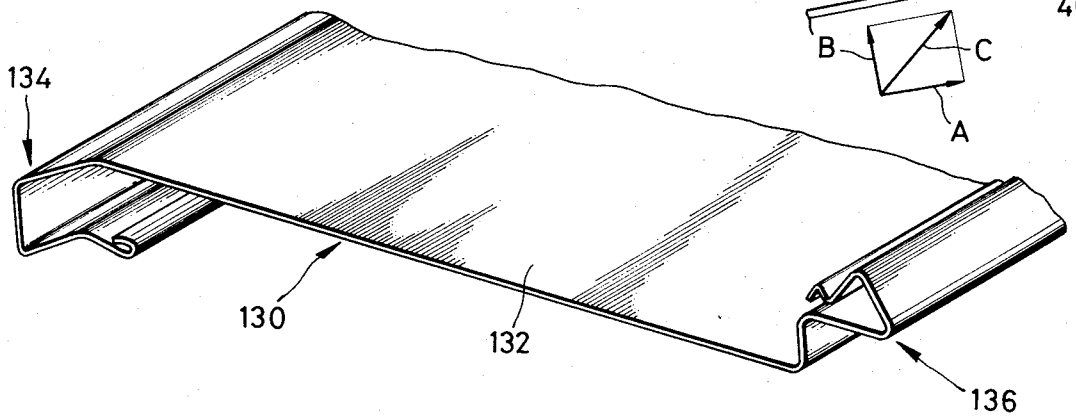
FIG. 7 is a fragmentary perspective view showing an embodiment of a roof board according to the present invention.

FIG. 7 illustrates an embodiment of a roof board according to the present invention, wherein a roof board is generally designated by reference numeral 130.

In the embodiment shown in FIG. 7, the roof board 130 may be constructed in substantially the same manner as the conventional one described above, except for a lower side or eaves side connection 134 and an upper side or ridge side connection 136. More particularly, The roof board 130 may be formed by subjecting a lengthwise steel sheet of a predetermined width, to which baking finish for rust prevention was applied, to a shaping treatment using a suitable forming machine to have a flat surface section 132 interposed between the eaves side connection 134 and the ridge side connection 136. The so-shaped steel sheet is then cut into roof boards of a predetermined width. The roof board may be formed at both sides thereof with lateral connections (not shown) which serve to laterally connect a plurality of the roof boards therethrough to each other in turn. For example, one of the lateral connections may be formed by turning up one side of the roof board and the other lateral connection may be formed by turning down the other side thereof.

In the illustrated embodiment, the lower side or eaves side connection 134 is formed into a substantially C shape to have an upper front face section section 140 connected at one end or an upper end thereof to the one end of the flat surface section 132 so as to downwardly extend therefrom, an inwardly extending section 142 connected at one end thereof to the other end or a lower end of the upper front face section 140 so as to inwardly extend therefrom and upwardly curved at a middle portion 144 thereof, and an engagement section 146 formed by turning up the other end of the inwardly extending section 142. In the illustrated embodiment, the upper front face section 140 is connected to the flat surface section through a top section 138 outwardly and obliquely downwardly enxtending from the one end of the flat surface section 132.

The upper side or ridge side section 136 is formed to have a lower front face section 180 connected at one end thereof to the other end of the flat surface section 132 and upwardly extending therefrom, an outwardly extending section 148 relative to flat surface 132 section connected at one end thereof to an upper end of the lower front face section 180 so as to outwardly straightly extend therefrom, an envelope section 149 formed by turning up the other end portion of the outwardly extending section 148, and a mount-shaped or mounted section 150 obliquely upwardly and inwardly extending from the envelope section 149. The mount-shaped section 150 is formed with crests 152 and 154 in order. The ridge side connection 136, when engaged with an eaves side connection of an adjacent upper side roof board, is adapted to abut the upper end of the lower front face section 180 against a lower end of an upper front face section section 140 of the upper side roof board, receive an engagement section 146 of the adjacent roof board in the envelope section 149 inwardly extending section 142 relative to flat surface section 132 between the mount-shaped section 150 and the outwardly extending section 148, and receive the mount-shaped section 150 in an eaves side connection 134 of the adjacent roof board.

Now, the manner of connection between each adjacent two of a plurality of the roof boards 130 each constructed as described above to each other will be described hereinafter with reference to FIGS. 7 and 8.

Figure 8:
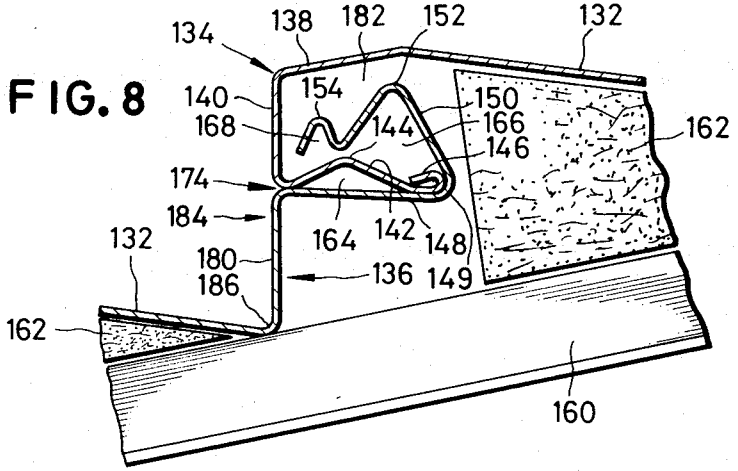
FIG. 8 is a fragmentary vertical sectional view showing an engagement between an eaves side connection and a ridge side connection in a roof structure constructed by the roof boards shown in FIG. 7.
Figure 9:
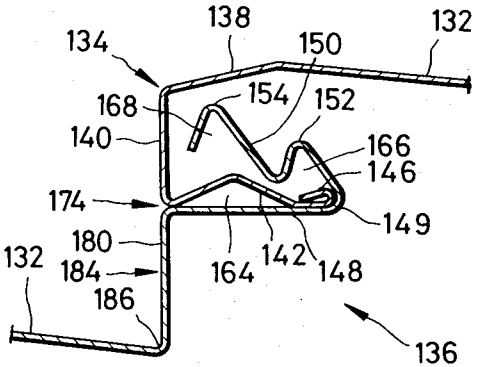
Figure 9:
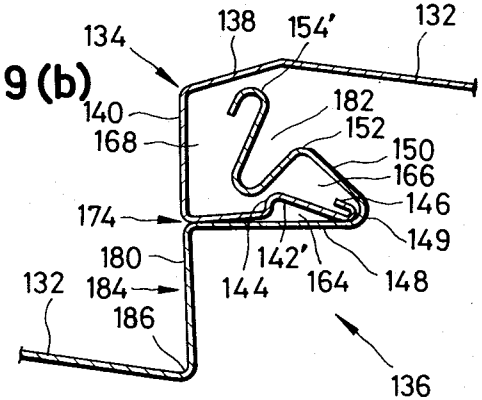
Figure 9:
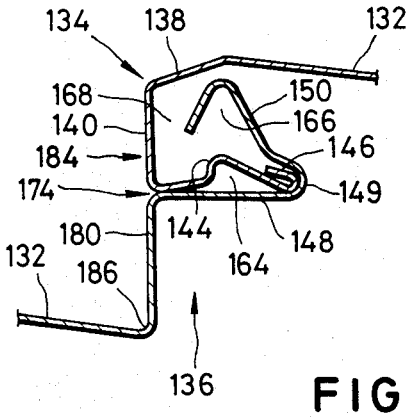
Figure 9:
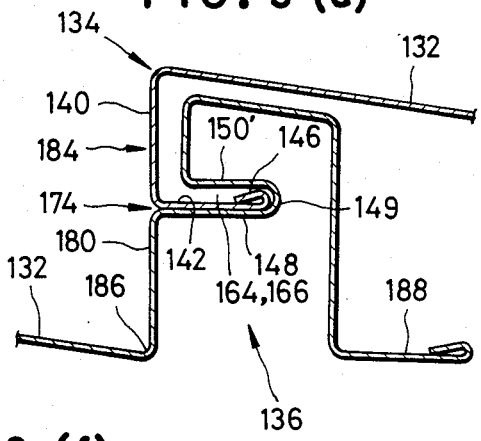
Figure 9:
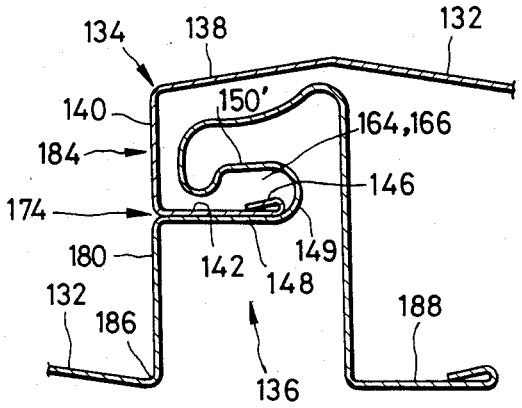
Figure 9:
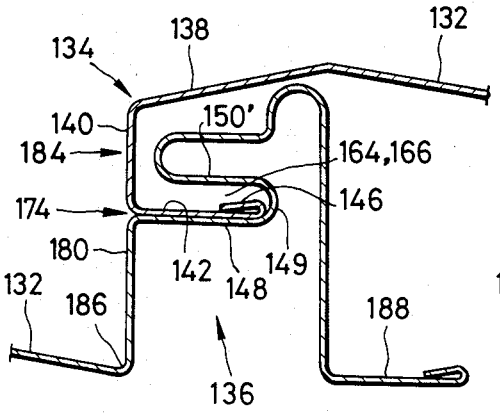
Figure 9:
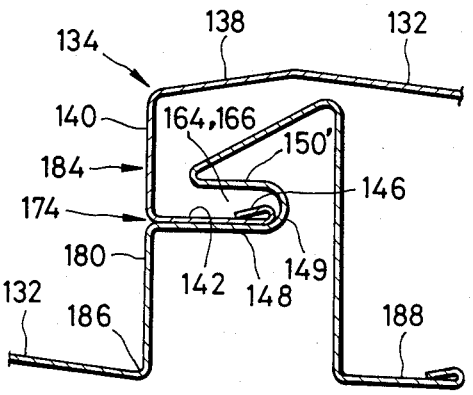

First, the eaves side or lower side one of the adjacent two roof boards 130 is mounted on a mounting base 160 such as common rafters through an excelsior board 162 arranged therein so as to act as a backing plate using a suitable means such as fixtures, and then the upper side or ridge side one of the adjacent two roof boards is mounted on the mounting base 160 in substantially the same manner and connected to the eaves side side roof board 130 by engaging the ridge side connection 136 of the eaves side roof board 130 with the eaves side connection 134 of the ridge side roof board 130 in a manner to abut the upper end of the lower front face section 180 of the eaves side roof board 130 against the lower end of the upper front face section 140 of the ridge side roof board 130, receive the inwardly extending section 142 of the ridge side roof board 130 between the mount-shaped section 150 and the outwardly extending section 148 of the eaves side roof board 130, receivedly engage the engagement section 146 of the ridge side roof board with the envelope section 149 of the eaves side roof board and receive the mount-shaped section 150 in the eaves side connection 134 of the ridge side roof board 130, as shown in FIG. 8. Such mounting and connection of the roof boards are repeated, so that a roof structure may be completed. It is a manner of course that the lowermost roof board and uppermost roof board may be free of an eaves side connection and a ridge side connection, respectively.

The connection of the roof boards 30 as described above causes a first evacuated space 164 to be defined between the curved-up middle portion 144 of the inwardly extending section 142 of the ridge side roof board and the outwardly extending section 148 of the ridge side roof board, second and third evacuated spaces 166 and 168 to be respectively formed at insides of the crests 152 and 154 of the mount-shaped section 150 of the eaves side roof board and a fourth evacuated space 182 to be formed between the top section 138 of the ridge side roof board and the mount-shaped section 150 of the eaves side roof board.

In the roof structure constructed as described, the engagement between the vertically adjacent two roof boards has a height corresponding to the sum of the upper front face section 140 and the lower front face section section 180 forming together a vertical surface 184, and a butt region 174 in the engagement between both roof boards is formed on a portion of the vertical surface 184 which is positioned vertically apart from the flat surface section 132 of the lower side or eaves side roof board 130.

Accordingly, in the roof structure, wind and rain blown up along the flat surface section 132 concentratedly strike a connection 186 between the flat surface section 132 and the lower front face section 180 and are decreased in force to a degree sufficient to be prevented from being blown up along the vertical surface 184. Thus, the roof structure highly decreases or substantially prevents the penetration of rain accompanying sand, mud, dust and the like through the butt region 174 thereinto. Further, the roof structure effectively prevents mud and the like from being collected on the connection 186 between the flat surface section 132 and the lower front face section 180, because the connection is smoothly formed without any gap to a degree sufficient to be washed out by rainwater whenever it rains. A large scale experiment made by the inventor proved that the present invention effectively exhibits such advantages.

Figure 9:
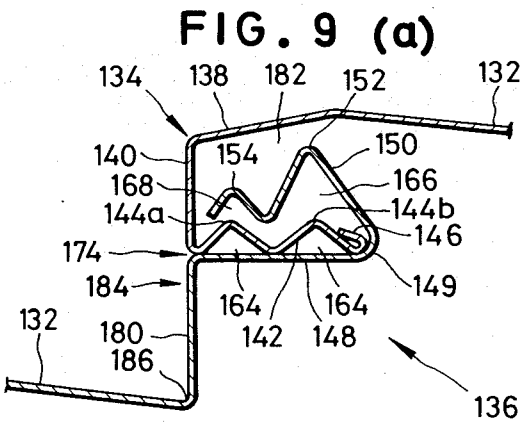
FIGS. 9(*a*) to 9(*h*) each are a fragmentary vertical sectional view showing a modification of the roof board shown in FIG. 7.

FIGS. 9(*a*) to 9(*h*) each show a modification of the roof board shown in FIG. 7.

A modification shown in FIG. 9(*a*) is constructed in such a manner that an inwardly extending section 142 of an eaves side connection 134 is formed with two crests 144*a* and 144*b*. In a roof board 130 shown in each of FIGS. 9(*b*) and 9(*d*), an upwardly curved portion 144 of an inwardly extending section 142 and a mount-shaped section 150 are deformed. In a modification of FIG. 9(*c*), a mount-shaped section 150 is formed with a low crest 152 and a high crest 154 in order in contrast with the roof board shown in FIG. 8. A modification shown in FIG. 9(*e*) is constructed in such a manner that a straightly extending section 150' acting as a mounted section is substituted for the mount-shaped section 150 in FIG. 7 and a mounted portion 188 through which a roof board is mounted on a mounting base or common rafters (not shown) is formed at the straightly extending section 150'. Also, an inwardly extending section is formed so as to straightly extend. Roof boards shown in FIGS. 9(*f*) to 9(*h*) each are directed to a further modification of the modified roof board shown in FIG. 9(*e*). The remaining part of each of the roof boards shown in FIGS. 9(*a*) to 9(*h*) is constructed in substantially the same manner as that shown in FIG. 7. It will be readily noted that each of the modifications exhibits like advantages.

Figure 10:
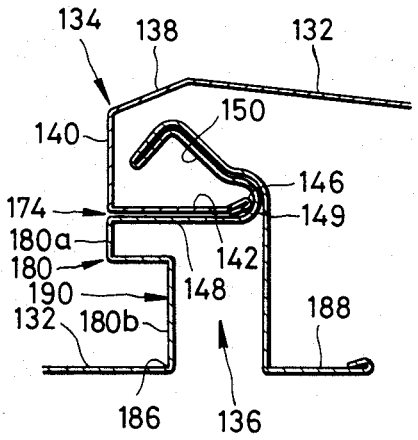
FIGS. 10 to 18 each are another embodiment of a roof board according to the present invention.

FIG. 10 illustrates another embodiment of a roof board according to the present invention. A roof board 130 shown in FIG. 10 is constructed in such a manner that a lower front face section 180 of a ridge side connection 136 is formed with a recess 190 which extends in the horizontal direction to divide the section 180 into an upper vertical portion 180*a* and a lower vertical portion 180*b*, and a mount-shaped section 150 is folded to form a mounted portion 188 through which the roof board is mounted on a mounting base or common rafters (not shown). The remaining part of the roof board 130 is constructed in substantially the same manner as that shown in FIG. 7. The roof board 130 shown in FIG. 10 exhibits, in addition to the advantages of the roof board of FIG. 7, an advantage of suppressing the rebound of wind and rain concentratedly blown against a connection 186 between a flat surface section 132 and the lower front face section 180 and promoting the smooth flow of wind and rain along the connection 186.

Figure 11:
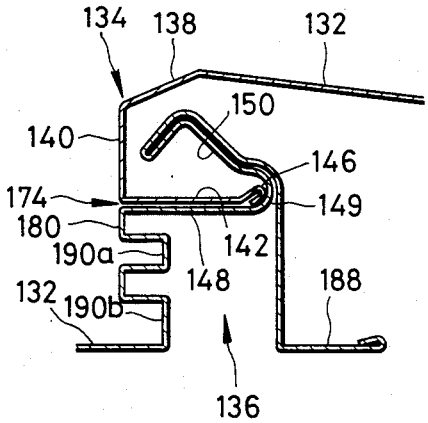

FIG. 11 shown a modification of the roof board shown in FIG. 10. A roof board 130 shown in FIG. 11 is constructed in substantially the same manner as that of FIG. 10 except that two horizontally extending recesses 190*a* and 190*b* are arranged in a manner to be vertically adjacent to each other.

Figure 12:
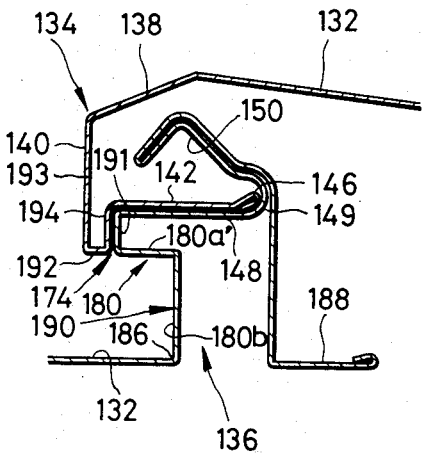

FIG. 12 shows a further embodiment of a roof board according to the present invention. In a roof board 130 shown in FIG. 12, a lower front face section 180 of a ridge side connection 136 is formed with an horizontally extending recess to divide the section 180 into an upper horizontal portion 180*a'* and a lower vertical portion 180*b*. The lower front face section 180 is connected to an outwardly extending section 148 through an upward step 191. An upper front face section 140 of an eaves side connection 134 is formed to have a vertical portion 193 downwardly extending from a top section 138 and a horizontal portion 192 inwardly extending from a lower end of the vertical portion 193, and connected to an inwardly extending section 142 through an upward step 194 having a height substantially equal to the step 191. The connection between the eaves side connection 134 and the ridge side connection 136 for forming a roof structure is carried out by mating the step 194 of the eaves side connection 134 with the step 191 of the ridge side connection 136 to abut an inner end of the horizontal portion 192 against an outer end of horizontal portion 180*a'*, to thereby form a butt region 174 which is upwardly spaced from the flat surface section 132 and directed in the downward direction. The remaining part of the roof board is constructed in substantially the same manner as that shown in FIG. 10. The illustrated embodiment exhibits, in addition to the advantages of each of the above-described embodiments, an advantage of preventing wind and rain from penetrating directly through the butt region 174 into an interior of the roof structure, because the butt region is downwardly directed. Also, the embodiment has another advantage that the roof structure looks fine externally, because the butt region is out of sight.

Figure 13:
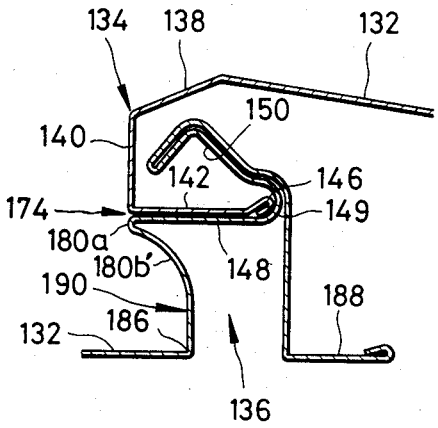

A further embodiment of a roof board according to the present invention is shown in FIG. 13. In a roof board 130 shown in FIG. 13, a lower front face section 180 comprises a lower concave portion 180*b'* upwardly outwardly curved from a flat surface section 132 and an upper vertical portion 180*a* upwardly extending from an upper end of the lower concave portion 180*b'*. The remaining part of the roof board is constructed in substantially the same manner as that of FIG. 10. The illustrated embodiment exhibits a further advantage of directing wind and rain rebounding from the roof board to a direction away from a butt region 174 between an eaves side connection 134 and ridge side connection 136.

Figure 14:
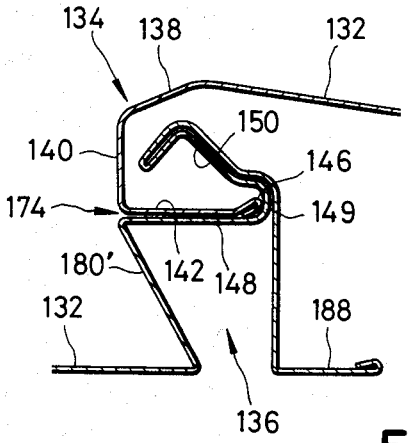

FIG. 14 shows another embodiment of a roof board according to the present invention. In a roof board 130 shown in FIG. 14, a ridge side connection 136 has a lower front face section 180' formed to extend obliquely inwardly and linearly from a flat surface section 132. The remaining part of the roof board is constructed in a manner like that shown in FIG. 13. The roof board 130 has substantially the same advantages as that of FIG. 13.

Figure 15:
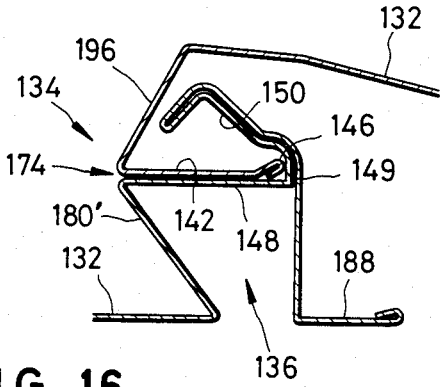

FIG. 15 shows a modification of the roof board shown in FIG. 14. In a roof board 130 of FIG. 15, an eaves side section 134 is constructed in such a manner that a section 196 extending obliquely outwardly and straightly from a flat surface section 132 is substituted for a top section 138 and an upper front face section 140 in the roof board 130 shown in FIG. 14. A lower end of the section 196 is abutted against an upper end of the lower front face section 180 to form a butt region 174 directed in the lateral direction. The remaining part of the roof board of FIG. 15 is constructed in substantially the same manner as that of FIG. 14. The roof board 130 of FIG. 15 exhibits, in addition to the advantages of the roof board shown in FIG. 14, an advantage of carrying out more satisfied drainage.

Figure 16:
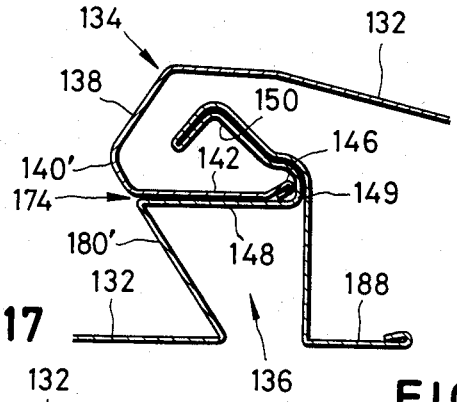

FIG. 16 shows another modification of the roof board shown in FIG. 14. In a roof board 130 shown in FIG. 16, an eaves side connection 134 is constructed to have a top section 138 obliquely downwardly extending from a flat surface section 132 and an upper front face section 140' extending obliquely inwardly downwardly from the top section 138 at the same slanting angle as an oblique lower front face section 180' so that the sections 140, and 180' may be aligned with each other to form the same plane and a butt region 174 may be formed on the plane when a roof structure is assembled. The remaining part of the roof board 130 shown in FIG. 16 is constructed in substantially the same manner as that of FIG. 14. The roof board 130 of FIG. 16 exhibits, in addition to the advantages of the roof board shown in FIG. 14, an advantage of more effectively preventing wind and rain from penetrating through the butt region 174 into an interior of the roof structure.

Figure 17:
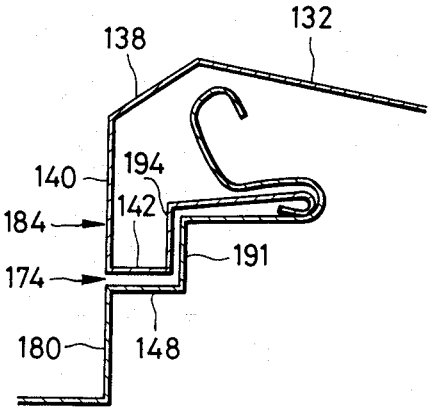
Figure 18:
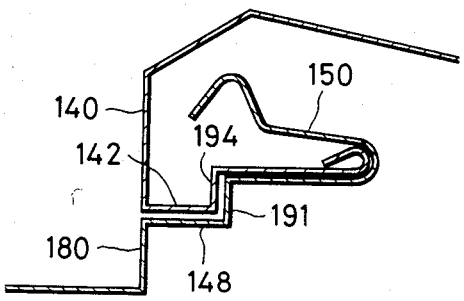

FIG. 17 shows still another embodiment of a roof board according to the present invention. A roof board 130 shown in FIG. 17 is constructed in such a manner that a butt region 174 is formed on a vertical surface 184 defined by an downwardly extending section 140 of an eaves side connection and an upwardly extending section 180 of a ridge side connection, and an inwardly extending section 142 of the eaves side connection and an outwardly extending section 148 of the ridge side connection are formed with steps 194 and 191, respectively. Such construction effectively prevents wind and rain from penetrating through the butt region 174 into a roof structure formed. The steps 191 and 194 each may be formed to have such a small height as shown in FIG. 18.

Figures 19, 20:
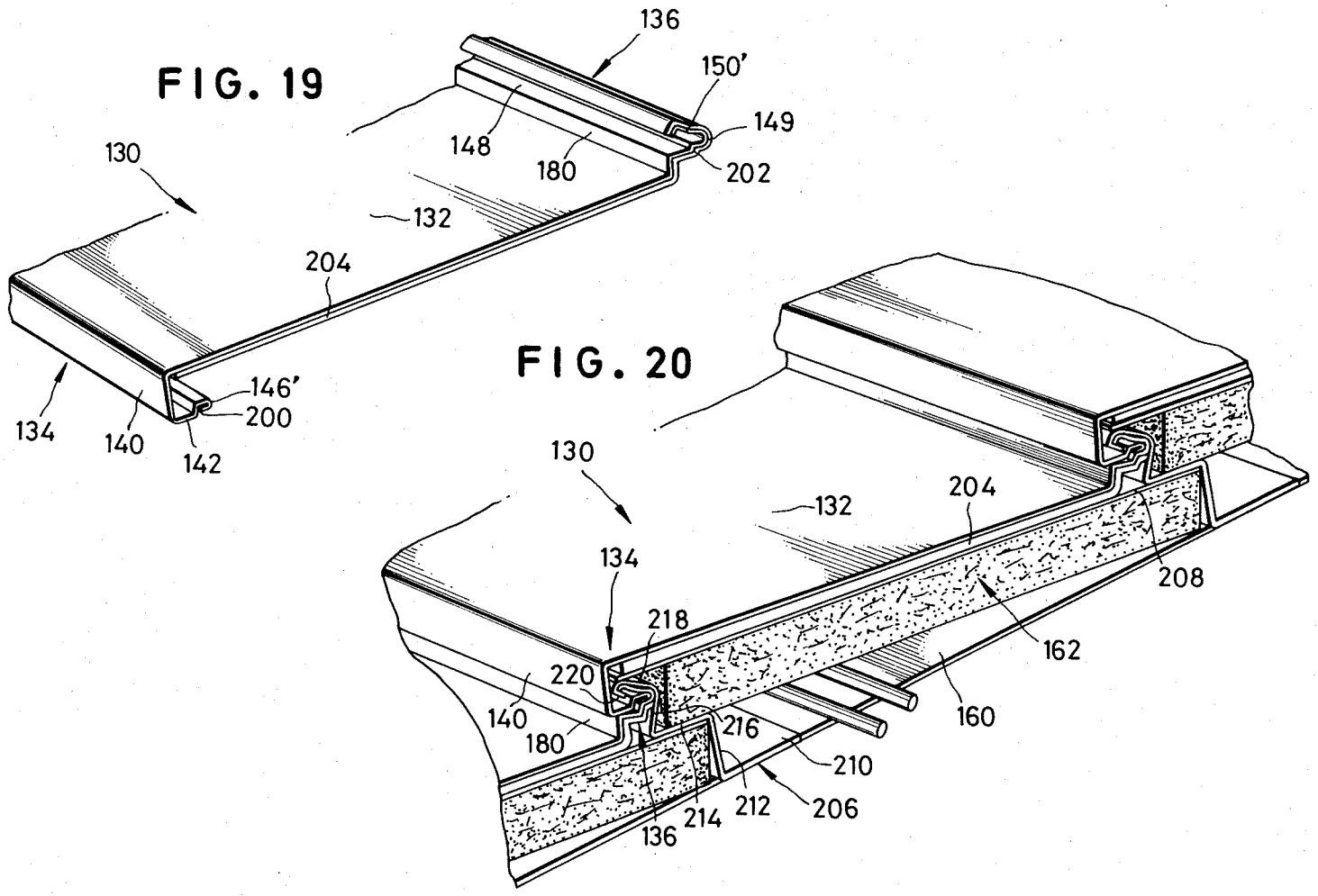
FIG. 19 is a fragmentary perspective view showing a further embodiment of a roof board according to the present invention.
FIG. 20 is a fragmentary perspective view in section showing an engagement between an eaves side connection and a ridge side connection in a roof structure constructed by the roof boards shown in FIG. 19.

FIG. 19 shows yet another embodiment of a roof board according to the present invention. A roof board 130 shown in FIG. 19 may be made in substantially the same way as that shown in FIG. 7. More particularly, it may be formed by subjecting a lengthwise steel sheet of a predetermined width, to which baking finish for rust prevention was applied, to a shaping treatment using a suitable forming machine so that it may have a flat surface section 132, an eaves side connection 134 contiguous to one end of the flat surface section 132 and a ridge side connection 136 contiguous to the other end of the section 132. The so-shaped steel sheet is then cut into roof boards of a predetermined width.

In the embodiment shown in FIG. 19, the lower side connection or eaves side connection 134 is likewise formed into a substantially C shape. More particularly, it comprises an upper front face section 140 connected at one end or an upper end thereof to an end portion 138' of the flat surface section 132 so as to downwardly extend therefrom, an inwardly extending section or abutment section 142 connected at one end thereof to a lower end of the upper front end section 140 so as to inwardly extend therefrom, and an engagement section 146' formed at the other end of the abutment section 142 through an upward step 200 of a small distance. The engagement section 146' is formed by turning down the other end of the abutment section 142.

The upper side or ridge side section 136 is formed to have a lower front face section section 180 connected at one end thereof to the other end of the flat surface section 142 so as to be upwardly extend therefrom, an outwardly extending section or extension section 148 connected at one end thereof to an upper end of the lower front face section section 180 so as to extend outwardly and slightly obliquely downwardly extend therefrom, an envelope section 149 formed by turning up a distal end of the extension section 148, and a mounted section 150' obliquely upwardly and inwardly extending from the envelope section 149 through an upward step 202 of a small distance. The mounted section 150' is formed with a crest 152 (FIG. 21), so that a distal end of the section 150' may be obliquely downwardly directed. Also, in the illustrated embodiment, a sound-proofing and heat-insulating material layer 204 is applied onto a rear surface of a portion of the roof board 130 extending from the flat surface section 132 to the ridge connection 136 by means of adhesive.

Figure 21:
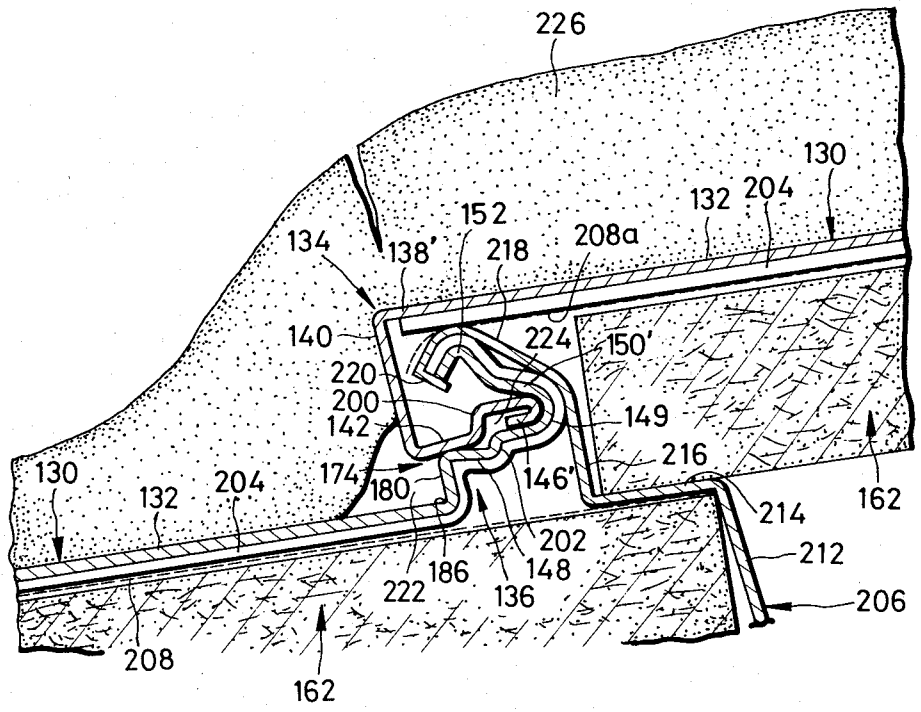
FIG. 21 is a fragmentary enlarged sectional side view detailedly showing the engagement of FIG. 20.

The connection between each adjacent two of a plurality of the roof boards 130 each constructed as described above for constructing a roof structure may be carried out by means of backing plates 162 of suitable dimensions such as excelsior boards or the like and fixtures 206 for fixing the roof boards 130 through the backing plates on a mounting base 160 upwardly slanting from an eaves side to a ridge side such as common rafters, as shown in FIGS. 20 and 21. In this instance, a felt sheet 208 may be interposed between an upper surface of each of the backing plates 162 and the heat-insulating and sound-proofing layer 204 in a manner to be outwardly projected from an eaves side end of the backing plate 162. The fixtures 206 each may be formed of a suitable material such as metal, plastic or the like into a stair-like shape so as to have a flat base portion 210 adapted to be mounted on the mounting base 160, a first vertical portion 212 upwardly extending from the base portion 210, a horizontal portion 214 outwardly extending from the vertical portion 212, a second vertical portion 216 upwardly extending from the horizontal portion 214, and a holding portion 218 formed at an upper end of the second vertical portion 216 into a shape sufficient to hold the mounted section 150 of the ridge side connection 136 therein as shown in FIGS. 20 and 21. The holding portion 218 is preferably inwardly bent at a distal end thereof to surround the end of the mounted section 150', as indicated at 220 in FIG. 21. The first vertical portion 212 of the fixture 206 serves to hold a rear end of an excelsior board 162 for a lower side roof board 130 in cooperation with the horizontal portion 214, and the horizontal portion 214 serves to support thereon a front end of an excelsior board 162 for an adjacent upper side roof board 130.

The ridge side connection 136, when engaged with an eaves side connection 134 of an adjacent upper side roof board, is adapted to abut the upper end of the lower front face section 180 against a lower surface of an abutment section 142 of the adjacent roof board, receive an engagement section 146' of the adjacent roof board in the envelope section 149, and receive the mounted section 150' in an eaves side connection 134 of the adjacent roof board.

Now, the manner of connection between each adjacent two of a plurality of the roof boards 130 will be described hereinafter with reference to FIGS. 20 and 21.

First, the lower side or eaves side backing plate or excelsior board 162 is arranged on the mounting base 160 such as common rafters and then the lower side or eaves side roof board 130 is mounted through the excelsior board 162 on the mounting base 160 by means of the fixture 206, so that the backing plate 162 may be securely fixed with respect to the mounting base 160 due to the cooperation between the first vertical portion 212 and horizontal portion 214 of the fixture 206. Also, this results in the mounted section 150' being securely held in the holding portion 218 of the fixture. Further. such operation causes the heat-insulating and sound-proofing layer 204 to be tightly arranged through the felt sheet 208 to a lower surface of the roof board 130.

Then, the upper side or ridge side one of the adjacent roof boards 130 is connected to the lower side or eaves side roof board 130 which has been mounted on the base members as described above. First, the backing plate 162 for the upper side roof board is supported at an eaves side end thereof on the horizontal portion 214 of the above-described fixture 206 for the lower side roof board. At this time, it is convenient that the end portion 208*a* of the felt sheet 208 of the backing plate 162 outwardly projecting therefrom is put on the holding portion of the fixture 206, as shown in FIG. 21. Then, the eaves side connection 134 of the upper side or ridge side roof board 130 is engaged with the ridge side connection 136 of the lower side or eaves side roof board 130. This is carried out in a manner to abut the upper end of the lower front face section 180 of the eaves side roof board 136 against the lower surface of the abutment section 142 of the ridge side roof board to form a butt region 174 positioned upwardly apart from the flat surface section 132 of the eaves side roof board, securely receive the engagement section 146' of the ridge side roof board in the envelope section 149 of the eaves side roof board 150' and securely hold the mounted section 150' in the eaves side connection 134 of the ridge side roof board. Thereafter, the ridge side roof board is fixed on the mounting base 160 by means of the fixture 206 in such a manner as described above. Such mounting and connection of the roof boards are repeated, so that a roof construction may be completed.

The connection of the roof boards 30 in order as described above causes the abutment section 142 of the upper side or ridge side roof board to be abutted at the lower surface thereof against the upper end of the lower front face section 180 of the eaves side roof board and the engagement section 146' of the ridge side roof board to be securely held in the envelope section 149 of the eaves side roof board in a manner to form an evacuated space 224 between the extension section 148 and the abutment section 142, resulting in rigid engagement between the ridge side connection of the eaves side roof board and the eaves side connection of the ridge side roof board. Also, this causes the laterally directed butt region 174 to be formed while the upper front face section 140 and a front portion of the abutment section 142 overhang the lower front face section 180 of the eaves side roof board, so that a space 222 may be defined between the overhanging portion of the abutment section 142 of the ridge side roof board and the flat surface section 132 of the eaves side roof board behind the lower front face section 180.

In the roof structure constructed as described, the connection between the adjacent two roof boards causes the butt region 174 to be rigidly formed at a position vertically apart from the flat surface section 132 of the eaves side roof board. Further, the evacuated space 224 is defined in an interior of the engagement between the eaves side connection and the ridge side connection, so that the engagement between the connections 134 and 146 may be more firmly carried out to cause the butt region to be more effectively tightened. Accordingly, in the roof construction, wind and rain blown up along the flat surface section 132 concentratedly strike a connection 186 between the flat surface section 132 and the lower front face section 180 to be decreased in force to a degree sufficient to be prevented from being blown up along the vertical surface 184. Thus, the roof structure highly decreases or substantially prevents the penetration of wind and rain accompanying sand, mud, dust and the like through the butt region 174 into the roof structure. Further, the roof structure effectively prevents mud and the like from being collected on the connection 186 between the flat surface section and the vertically extending section 180, because the connection is smoothly formed without any gap to a degree sufficient to be washed out by rain water whenever it rains.

Also, the abutment section 142 of the ridge side roof board is abutted against the upper end of the lower front face section 180 of the eaves side roof in a manner to downwardly press the section 180. This allows the above-described advantages to be effectively exhibited without providing the eaves and ridge side connections with high dimensional accuracy.

It will thus be seen that the objects set forth above, among those made apparent from the preceding description, are efficiently attained and, since certain changes may be made in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A roof board comprising:

a flat surface section, an eaves side connection formed at one end of said flat surface section, and a ridge side connection formed at the other end of said flat surface section, a plurality of said roof boards being adapted to be connected through said eaves side and ridge side connections to one another in order with an upward incline in the direction of from an eaves side to a ridge side to form a roof structure;

said eaves side connection being formed to have an upper front face section downwardly extending from said one end of said flat surface section, an inwardly extending section inwardly extending from a lower end of said upper front face section, and an engagement section formed at a distal end of said inwardly extending section;

said ridge side connection being formed to have a lower front face section upwardly extending from said the other end of said flat surface section, an outwardly extending section outwardly extending from an upper end of said lower front face section, and an envelope section formed at a distal end of said outwardly extending section;

the connection between each adjacent two of said roof boards being carried out above said ridge section by holding the engagement section of the ridge side one of said adjacent two roof boards in the envelope section of the eaves side one of said adjacent two roof boards and abutting the upper end of the lower front face section of said eaves side roof board against the eaves side connection of said ridge side roof board to form a butt region therebetween which is positioned upwardly apart from the flat surface section of said eaves side roof board and exposed to an exterior of said roof structure.

2. A roof board as defined in claim 2, wherein said upper end of said lower front face section of said eaves side roof board is abutted against the lower end of the upper front face section of said ridge side roof board.

3. A roof board as defined in claim 2, wherein said upper front face section and said lower front face section each are formed to straightly extend from said flat surface section, so that said butt region may be laterally directed.

4. A roof board comprising:

a flat surface section, an eaves side connection formed at one end of said flat surface section, and a ridge side connection formed at the other end of said flat surface section, a plurality of said roof boards being adapted to be connected through said eaves side and ridge side connections to one another in order with an upward incline in the direction of from an eaves side to a ridge side to form a roof structure;

said eaves side connection being formed to have an upper front face section downwardly extending from said one end of said flat surface section, an inwardly extending section inwardly extending from a lower end of said upper front face section, and an engagement section formed at a distal end of said inwardly extending section;

said ridge side connection being formed to have a lower front face section upwardly extending from said the other end of said flat surface section, an outwardly extending section outwardly extending from an upper end of said lower front face section, and an envelope section formed at a distal end of said outwardly extending section;

the connection between each adjacent two of said roof boards being carried out above said ridge section by holding the engagement section of the ridge side one of said adjacent two roof boards in the envelope section of the eaves side one of said adjacent two roof boards and abutting the upper end of the lower front face section of said eaves side roof board against the lower end of the upper front face section of said ridge side roof board to form a butt region therebetween which is positioned upwardly apart from said flat surface section of said eaves side roof board and exposed to an exterior of said roof structure.

5. A roof board comprising:

a flat surface section, an eaves side connection formed at one end of said flat surface section, and a ridge side connection formed at the other end of said flat surface section, a plurality of said roof boards being adapted to be connected through said eaves side and ridge side connections to one another in order with an upward incline in the direction of from an eaves side to a ridge side to form a roof structure;

said eaves side connection being formed to have an upper front face section downwardly extending from said one end of said flat surface section, an abutment section inwardly extending from a lower end of said upper front face section, and an engagement section formed at a distal end of said abutment section;

said ridge side connection being formed to have a lower front face section upwardly extending from said the other end of said flat surface section, an extension section outwardly extending from an upper end of said lower front face section, and an envelope section formed at a distal end of said outwardly extending section;

the connection between each adjacent two of said roof boards being carried out by holding the engagement section of the ridge side one of said adjacent two roof boards in the envelope section of the eaves side one of said adjacent two roof boards and abutting the upper end of the lower front face section of said eaves side roof board against a lower surface of the abutment section of said ridge side roof board in a manner to forwardly project the upper front face section of said ridge side roof board from the lower front face section of said eaves side roof board, so that a butt region may be formed between the ridge side connection of said eaves side roof board and the eaves side connection of said ridge side roof board which is positioned upwardly apart from the flat surface section of said eaves side roof board and exposed to an exterior of said roof structure.

6. A roof structure comprising:

a plurality of roof boards connected to one another in order with an upward incline in the direction of from an eaves side to a ridge side, said roof boards each comprising a flat surface section, an eaves side connection formed at one end of said flat surface section so as to be positioned below said flat surface section and a ridge side connection formed at the other end of said flat surface section so as to be positioned above said flat surface section;

said eaves side connection having an upper front surface section downwardly extending from said flat surface section, an inwardly extending section inwardly extending from a lower end of said upper front face section and an engagement section formed at a distal end of said inwardly extending section;

said ridge side connection having a lower front face section upwardly extending from said the other end of said flat surface section, an outwardly extending section outwardly extending from an upper end of said lower front face section, an envelope section formed by turning up a distal end of said outwardly extending section, and a mounted section upwardly extending from said envelope section;

the connection between each adjacent two of said roof boards being carried out above said ridge section in a manner to abut the upper end of the lower front face section of the eaves side one of said adjacent two roof boards against the eaves side connection of the ridge side one of said adjacent two roof boards to form a butt region between said eaves side roof board and said ridge side roof board which is positioned upwardly apart from the flat surface section of said eaves side roof board and exposed to an exterior of said roof structure.

7. A roof structure as defined in claim 6, wherein said upper end of said lower front face section of said eaves side roof board is abutted against the lower end of the upper front face section of said ridge side roof board.

8. A roof structure as defined in claim 7, wherein said upper front face section and said lower front face section each are formed to straightly extend from said flat surface section, so that said butt region may be laterally directed.

9. A roof structure as defined in claim 6, wherein said upper end of said lower front face section of said eaves side roof board is abutted against a lower surface of the inwardly extending section of said eaves side connection of said ridge side roof board.

10. A roof structure comprising:

a plurality of roof boards connected to one another in order with an upward incline in the direction of from an eaves side to a ridge side, said roof boards each comprising a flat surface section, an eaves side connection formed at one end of said flat surface section so as to be positioned below said flat surface section and a ridge side connection formed at the other end of said flat surface section so as to be positioned above said flat surface section;

said eaves side connection having an upper front surface section downwardly extending from said flat surface section, an inwardly extending section inwardly extending from a lower end of said upper front face section and an engagement section formed at a distal end of said inwardly extending section;

said ridge side connection having a lower front face section upwardly extending from said the other end of said flat surface section, an outwardly extending section outwardly extending from an upper end of said lower front face section, an envelope section formed by turning up a distal end of said outwardly extending section, and a mounted section upwardly extending from said envelope section;

the connection between each adjacent two of said roof boards being carried out in a manner to abut the upper end of the lower front face section of the eaves side one of said adjacent two roof boards against the lower end of the lower front face section of the ridge side one of said adjacent two roof boards to form a butt region between said eaves side roof board and said ridge side roof board which is positioned upwardly apart from the flat surface section of said eaves side roof board and exposed to an exterior of said roof structure.

11. A roof structure comprising:

a plurality of roof boards connected to one another in order with an upward incline in the direction of from an eaves side to a ridge side, said roof boards each comprising a flat surface section, an eaves side connection formed at one end of said flat surface section so as to be positioned below said flat surface section and a ridge side connection formed at the other end of said flat surface section so as to be positioned above said flat surface section;

said eaves side connection having an upper front surface section downwardly extending from said flat surface section, an abutment section inwardly extending from a lower end of said upper front face section and an engagement section formed at a distal end of said inwardly extending section;

said ridge side connection having a lower front face section upwardly extending from said the other end of said flat surface section, an outwardly extending section outwardly extending from an upper end of said lower front face section, an envelope section formed by turning up a distal end of said outwardly extending section, and a mounted section upwardly extending from said envelope section;

the connection between each adjacent two of said roof boards being carried out above said ridge section by abutting the upper end of the lower front face section of the eaves side one of said adjacent two roof boards against a lower surface of the abutment section of the ridge side one of said adjacent two roof boards in a manner to forwardly project the upper front face section of said ridge side roof board from said lower front face section of said eaves side roof board, so that a butt region may be formed between the ridge side connection of said eaves side roof board and the eaves side connection of said ridge side roof board which is positioned upwardly apart from the flat surface section of said eaves side roof board and exposed to an exterior of said roof structure.

12. A roof structure comprising:

a plurality of roof boards connected to one another in order with an upward incline in the direction of from an eaves side to a ridge side, said roof boards each comprising a flat surface section, an eaves side connection formed at one end of said flat surface section so as to be positioned below said flat surface section and a ridge side connection formed at the other end of said flat surface section so as to be positioned above said flat surface section;

said eaves side connection having an upper front surface section downwardly extending from said flat surface section, an abutment section inwardly extending from a lower end of said upper front face section and an engagement section formed at a distal end of said inwardly extending section;

said ridge side connection having a lower front face section upwardly extending from the other end of said flat surface section, an outwardly extending section outwardly extending from an upper end of said lower front face section, an envelope section formed by turning up a distal end of said outwardly extending section, and a mounted section formed at a distal end of said envelope section;

a backing plate arranged under each of said roof boards; and a fixture formed with a base portion adapted to be fixed on a mounting base for said roof structure, a step portion for downwardly forcing an eaves side end of said backing plate and supporting a ridge side end of said backing plate, and a holding portion for securely holding said mounted section of said roof board;

the connection between each adjacent two of said roof boards being carried out by positioning the eaves side one of said adjacent two roof boards on the backing plate therefor to press a ridge side end of said backing plate by the step portion of the fixture for said eaves side roof board and hold the mounted section of said eaves side roof board by the holding portion of said fixture, supporting an eaves side end of the backing plate for the ridge side one of said adjacent two roof boards by said step portion of said fixture, fitting the eaves side connection of said ridge side roof board in the ridge side connection of said eaves side roof board in a manner to hold the engagement section of said ridge side roof board in the envelope section of said eaves side roof board and abutting the upper end of the lower front face section of said eaves side roof board against a lower surface of the abutment section of said ridge side roof board in a manner to forwardly project the upper front face section of said ridge side roof board form said lower front face section of said eaves side roof board.

* * * * *